United States Patent [19]

Schuessler et al.

[11] 4,074,365

[45] Feb. 21, 1978

[54] CAP AND METHOD OF MANUFACTURE

[76] Inventors: Walter E. Schuessler, 800 Redbud Lane, Wilmette, Ill. 60091; Richard D. Schuessler, 142 Abingdon, Kenilworth, Ill. 60043

[21] Appl. No.: 762,658

[22] Filed: Jan. 28, 1977

[51] Int. Cl.[2] ..... A42B 1/04

[52] U.S. Cl. ..... 2/201; 2/199; 2/209.3; 46/154

[58] Field of Search ..... 2/201, 202, 203, 204, 2/205, 206, 192, 195, 199, 186, 209.3, 171; 46/154, 115; 66/169 R, 170

[56] References Cited

U.S. PATENT DOCUMENTS

| | | | |
|---|---|---|---|
| 1,179,631 | 4/1916 | Hurd | 2/209.3 X |
| 2,579,945 | 12/1951 | Maupin | 2/201 |
| 2,611,902 | 9/1952 | Rockmore | 2/199 |
| 3,308,479 | 3/1967 | Sesco, Jr. | 46/154 UX |
| 3,358,293 | 12/1967 | Wanamaker | 2/195 |
| 4,010,570 | 3/1977 | Kohler | 46/154 |

*Primary Examiner*—Werner H. Schroeder
*Assistant Examiner*—Peter Nerbun

[57] ABSTRACT

A cap is formed by inserting the upper end of a knitted tube into a pocket of a bag-like tassel. The tassel is expanded or stuffed by the upper end of the tube, and a suitable design can be applied to the tassel before the tube is inserted. The tassel includes a drawstring around the opening of the pocket, and the tassel is secured to the tube by pulling and tying the drawstring.

9 Claims, 5 Drawing Figures

10
11
12
13
14
15
16
17
18
19
20
21
22
23
24
25
26
28
29

CAP AND METHOD OF MANUFACTURE

BACKGROUND AND SUMMARY

This invention relates to caps, and, more particularly, to knit caps which include tassels.

A knit cap is conventionally formed from a knitted tube. One end of the tube is adapted to fit over the head of the person who is to wear the cap, and the other end of the tube is closed, as by stitching, to form the top or crown portion of the cap. Many knit caps are provided with a tassel or ball which is secured to the upper end of the tube by a spring or thread after that end is closed.

One problem with tassel caps is that the tassel is relatively floppy on the top of the cap since the tassel is attached at only one point. Further, once the string which attaches the tassel, or the yarn to which the tassel is attached, is stretched, the tassel becomes even looser and floppier. Since caps are often pulled by their tassels by playful children and pets, the likelihood of a tassel eventually becoming loose is substantial.

The invention provides a unique tassel which is firmly attached to the top of the cap and which has a unique, stuffed appearance. The tassel has a pocket into which the upper end of the tube is stuffed, and the tassel is attached to the tube by a drawstring around the opening of the pocket which provides a circumferential attachment rather than a point attachment. The combination of the circumferential attachment and the extension of the tube into the pocket of the tassel prevents any floppiness of the tassel so that the tassel sits upright on the top of the cap, and pulling on the tassel does not substantially affect the attachment. Since the upper end of the tupe is stuffed into the tassel, the step of closing the upper end of the tube is unnecessary and can be eliminated.

DESCRIPTION OF THE DRAWING

The invention will be explained in conjunction with an illustrative embodiment shown in the accompanying drawing, in which.

DESCRIPTION OF SPECIFIC EMBODIMENT

Figures 1, 2, 3, 4, 5:
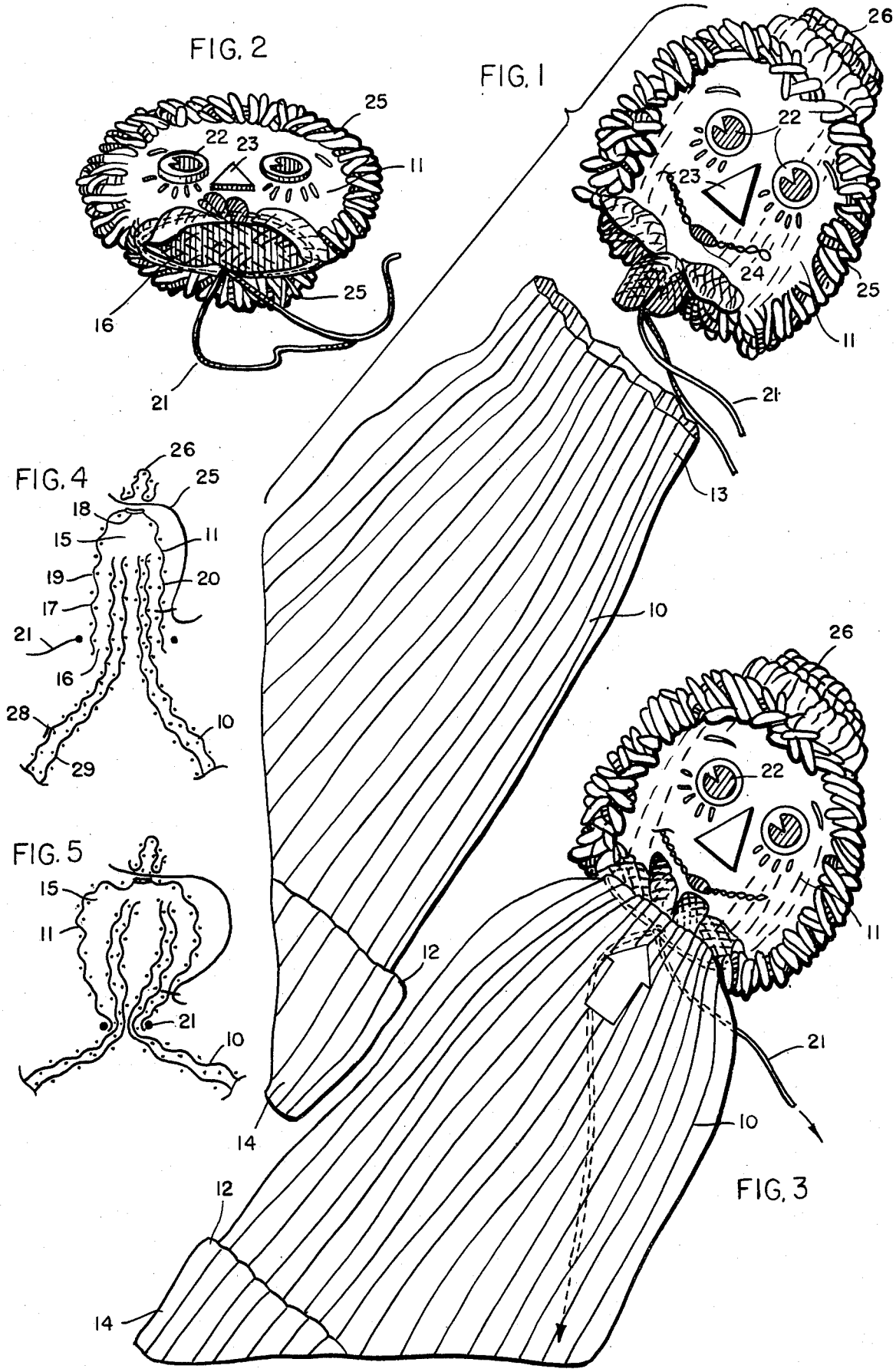
FIG. 1 is a fragmentary perspective view of a knitted tube and a tassel which will be combined to form a cap.
FIG. 2 is a perspective view of the tassel.
FIG. 3 is a fragmentary perspective view showing the upper end of the tube stuffed into the tassel and the drawstring about to be pulled.
FIG. 4 is a diagrammatic fragmentary sectional view through the upper end of the cap after the tube has been stuffed into the tassel.
FIG. 5 is a view similar to FIG. 4 after the drawstring has been pulled.

Referring now to the drawing, the cap is formed from a tube 10 and a tassel 11. The tube may be a conventional knitted tube made on a tubular knitting machine and includes an open bottom end 12 and an open upper end 13. The bottom end is sized to fit over the head of a person and is shown turned up to form a cuff 14. The tube may be knitted so that the upper portion of the tube is narrower than the bottom of the tube.

The tassel 11 is essentially a bag having an interior pocket 15. The bag is closed except at an opening 16 which permits the upper end of the tube 10 to be stuffed into the pocket.

The tassel shown in the drawing is formed from a knitted tube 17 (FIG. 4). The bottom opening of the tube provides the opening 16, and the top of the tube is closed by stitching 18. The tube is somewhat fattened and provides a pair of opposed layers 19 and 20. A drawstring 21 is secured to the bottom of the tassel around the periphery of the opening 16. The drawstring may be a piece of string which is attached to the tassel by weaving the string through the knitted strands of yarn which form the tassel.

The tassel is decorated in the form of a face by sewing a pair of eyes 22, a nose 23, and a mouth 24, all of which may be formed of cloth or other suitable material, to the layer 19. Hair 25, which may be strands of yarn or the like, is sewn to the layer 20, and a hat 26 is stitched to the top of the tassel. The pocket within the tassel between the two layers facilitates the attachment of the face and hair to the tassel. Although the tassel in the embodiment illustrated is decorated in the form of a face, it will be understood that other designs can be applied to the tassel.

The cap is formed by gathering the upper end 13 of the tube 10 and stuffing it through the opening 16 of the tassel into the pocket. As the upper end of the tube is stuffed into the tassel, the tassel is expanded outwardly. The tassel is decorated as the face of a rag doll in the embodiment illustrated, and the stuffed end of the tube 10 gives the face a rounded configuration and a stuffed appearance. After the end of the tube is stuffed into the tassel, the drawstring 21 is pulled tightly about the tube and tied. If desired, one or more stitches can be passed through the tassel and the tube to provide even more securement between the tassel and the tube.

The drawstring provides a circumferential or annular attachment to the tube rather than an attachment at a point, and the tube extends through the area of attachment and fills the pocket of the tassel. The tassel is thereby firmly attached to the upper end of the tube and will sit upright on the top of the cap rather than flopping to one side or another. This is true even when the length of the tube is such that the upper end of the tube extends well above the top of the head of the wearer. The gathered upper end of the tube which is tied by the drawstring reinforces the tube and restrains the tendency of the tube to sag.

The tassel will remain firmly attached to the tube even if the tassel is pulled. A pulling force exerted on the tassel parallel to the axis of the tube will have little tendency to stretch the drawstring, which exerts a radially constricting force on the tube. Even if the pulling force pulls the tassel along the tube toward the upper end of the tube, when the tassel is released the tassel will remain firmly secured by the drawstring.

In the particular embodiment illustrated the tube 10 is a double-layered tube having an outer layer 28 and an inner layer 29 (FIG. 4) which is formed by turning half of a long single-layered tube inside out. The layers are joined along the bottom end 12 of the double-layered tube, which was the middle of the single-layered tube, and the layers are separated at the upper end 13 of the tube. Ordinarily, the ends of the tube of a knit cap must be stitched to close the upper end and to prevent the ends of the layers from unraveling. However, in caps formed in accordance with the invention the upper end of the tube is tucked into the pocket of the tassel. Stitching the upper end of the tube is therefore unnecessary, and this step can be eliminated, thereby saving labor cost.

While in the foregoing specification a detailed description of a specific embodiment of the invention was set forth, it will be understood that many of the details herein given may be varied considerably by those skilled in the art without departing from the spirit and scope of the invention.

We claim:

1. A cap comprising a knitted tubular head portion having an open lower end adapted to fit over the head of a wearer and an upper end, a bag-like top portion having an opening forming a pocket therein, the upper end of the head portion extending through the opening into the pocket of the top portion, and constricting means extending around the opening of the top portion for constricting the opening about the head portion.

2. The cap of claim 1 in which the constricting means is a drawstring which is secured to the top portion around the opening therein and drawn tightly against the portion of the head portion which extends through the opening.

3. The cap of claim 1 in which the top portion is a knitted bag, the upper end of the head portion expanding the bag outwardly from the constricting means.

4. The cap of claim 3 in which the constricting means is a drawstring which is secured to the top portion around the opening therein and drawn tightly against the portion of the head portion which extends through the opening.

5. A method of making a cap comprising the steps of:

knitting a tubular head portion having a lower end adapted to fit over the head of a wearer and an upper end, making a bag-like top portion having an opening forming a pocket therein, inserting the upper end of the head portion into the pocket of the top portion, and constricting the opening in the top portion slightly around the portion of the head portion which extends through the opening to squeeze the upper end of the head portion together.

6. The method of claim 5 including the step of applying a design of a face to the top portion before the upper end of the head portion is inserted into the pocket.

7. The method of claim 5 in which the top portion is made by knitting a tube having an open upper end and an open lower end and closing the upper end of the tube.

8. The method of claim 7 in which a drawstring is attached to the tube which forms the top portion around the open lower end thereof.

9. The method of claim 5 in which the opening in the top portion is constricted by pulling a drawstring which extends around the opening of the top portion.

* * * * *

UNITED STATES PATENT AND TRADEMARK OFFICE

CERTIFICATE OF CORRECTION

PATENT NO. : 4,074,365

DATED : February 21, 1978

INVENTOR(S) : Walter E. Schuessler et al

It is certified that error appears in the above-identified patent and that said Letters Patent are hereby corrected as shown below:

In column 4, line 9, "slightly" should be --tightly--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*